United States Patent [19]

Herbst

[11] 4,043,481

[45] Aug. 23, 1977

[54] SCORED METAL FLAP AREAS

[75] Inventor: Edward J. Herbst, Posen, Ill.

[73] Assignee: Continental Can Company, Inc., Chicago, Ill.

[21] Appl. No.: 729,463

[22] Filed: Oct. 4, 1976

Related U.S. Application Data

[62] Division of Ser. No. 596,502, July 16, 1975, Pat. No. 4,027,612.

[51] Int. Cl.[2] ..... B65D 41/32

[52] U.S. Cl. ..... 220/266; 220/268; 220/89 A

[58] Field of Search ..... 220/266, 268, 89 A; 113/121 C; 222/541

[56] References Cited

U.S. PATENT DOCUMENTS

| | | | |
|---|---|---|---|
| 3,912,113 | 10/1975 | Peyser et al. | 220/268 |
| 3,912,114 | 10/1975 | Morran et al. | 220/268 |
| 3,997,076 | 12/1976 | Jordan | 220/268 |

*Primary Examiner*—George T. Hall

*Attorney, Agent, or Firm*—Diller, Brown, Ramik & Wight

[57] ABSTRACT

The invention is directed to a metallic easy-opening can end, and to a method of manufacturing the same, the can end having a tear panel which is highly resistant to blowout pressure. The can end is first drawn between a preforming punch and a die to an outwardly open concave configuration, and is thereafter compression scored between a scoring punch and a scoring anvil to reduce the thickness of the drawn metal, thus forming the removable tear panel.

5 Claims, 6 Drawing Figures

SCORED METAL FLAP AREAS

This is a divisional application Ser. No. 596,502 filed July 16, 1975 issued under Pat. No. 4,027,612.

The invention relates to a metallic can end or end unit, and to a method of manufacturing the same, the can end or end unit having a tear panel which is highly resistant to blowout from internal pressure.

The method comprises two steps wherein the tear panel or flap area is first preformed into an outwardly opening concave configuration so as to obtain an initial resistance to blowout pressure, and is then scored in such a manner as not only to create an area of reduced thickness along the score line, but also to lessen the radius of curvature of the flap area with a resulting increase in blowout resistance.

Easy opening cans for packaging carbonated beverages and other liquids have been widely accepted by the public and have experienced substantial commercial success since they eliminate the necessity of an opener or similar tool. In most cans or containers of this type, a pull tab or lever is permanently joined to a tear panel, tear strip or flap area in the metal end of the container. The tear panel is configured so that, upon removal, there is provided an opening through which to pour or drink liquid. Typically, the tear panel is removed by exerting a force on the pull tab or lever to rupture a continuous score line which has been formed along the outermost boundary of the tear panel during the manufacturing process.

In the process of forming such scored tear panels, it has been necessary to score the can end in such a way as to minimize the amount of physical force necessary to be exerted on the pull tab in order to rupture the score and remove the tear panel. In this regard, a major problem develops in that, as a can end is scored to such an extent as to minimize the physical force necessary to remove the tear panel, the risk of explosive detachment of the tear panel due to blowout pressure from within the container increases.

It has been recognized in the prior art that scoring in a circular shape by a one-step method produces a metal flow within the score, which metal flow produces a spherical configuration which by itself improves the blowout resistance of the tear panel. However, this resistance is often not sufficient to prevent blowout due to the pressure built up within a container containing certain liquids, for example, carbonated beverages.

The prior art also discloses scored tear panels formed by a two-step method. For example, such disclosures are contained in U.S. Pat. No. 3,757,989 (Brown) and U.S. Pat. No. 3,411,470 (Fraze). However, these patents teach two-step methods unrelated to the two-step method taught herein. Moreover, the two patents teach methods which are intended to solve special problems completely unrelated to blowout pressure resistance.

The present invention relates to a tear panel formed by scoring the metal end wall of a container, and the method for forming the same. According to the invention, an area to be scored, designated as the tear panel, tear strip or flap area, within the metal end wall of a container is first drawn between a preforming punch and a die so as to be deformed into a generally curved shape, the tear panel thus being endowed with an initial resistance to blowout pressure. The preformed tear panel is then scored between a scoring punch and a scoring anvil in such a manner as to have two effects.

First, a web of reduced thickness is created along the outermost boundary of the tear panel so as to form a score line. Second, the preformed tear panel is further deformed so as to be endowed with an additional resistance to blowout pressure from within the container.

Therefore, it is an object of the invention to form scored tear panels which have a high degree of resistance to blowout pressure from within the container.

With the above and other objects in view that will hereinafter appear, the nature of the invention will be more clearly understood by reference to the following detailed description, the appended claimed subject matter, and the several views illustrated in the accompanying drawings.

Figure 1:
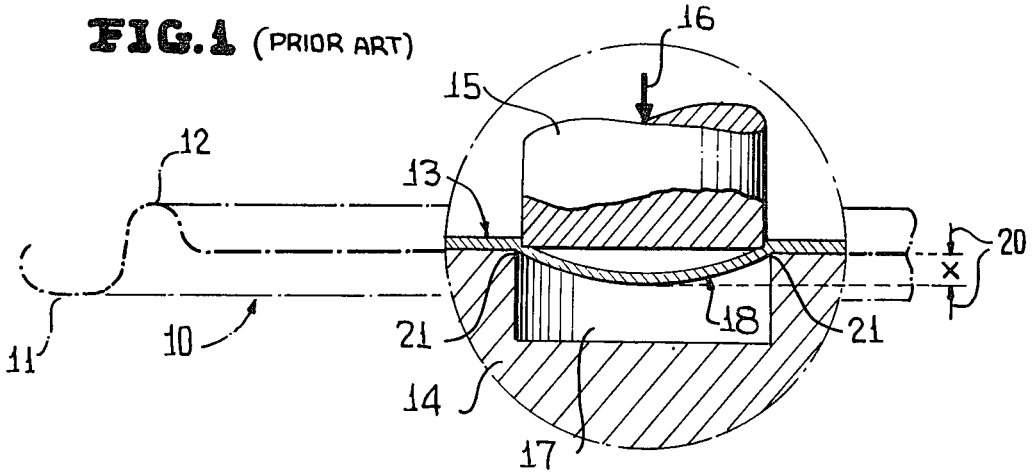
FIG.1 (PRIOR ART)
FIG. 1 is a fragmentary, schematic, cross-sectional view of a metal tear panel, and illustrates the manner in which it is formed by a commonly used prior art method.

As mentioned previously, the prior art teaches a one-step method of scoring a can end to form a tear panel which, however, provides pressure resistance which is insufficient in many cases. Such a method is shown in FIG. 1. Typically, the end unit 10 of a container (not shown) has at its outermost extremity a flange 11 and a bead 12 for seaming the end unit 10 to the side walls (not shown) of the container. The end unit 10 further includes an end wall 13 which, by the known method, is situated between a scoring anvil 14 and a scoring punch 15, the latter being moved in a direction indicated by the arrow 16 so as to exert a compressive force on the end wall 13. The anvil 14 has a cavity 17 so that, when the aforementioned compressive force acts on the end wall 13, a deformed tear panel, tear strip or flap area 18 is formed, whereby the maximum distance of deformation of the flap area is a distance X, as indicated by the arrows 20. This forms a score line or web 21 or reduced thickness along the edge of the deformed flap area 18 so as to facilitate removal of the same. In addition, the deformation of the flap area 18 does provide, as a side effect, some resistance to blowout pressure from within the container.

In contrast, the present invention shall now be described as set forth in FIGS. 2 through 6.

Figure 2:
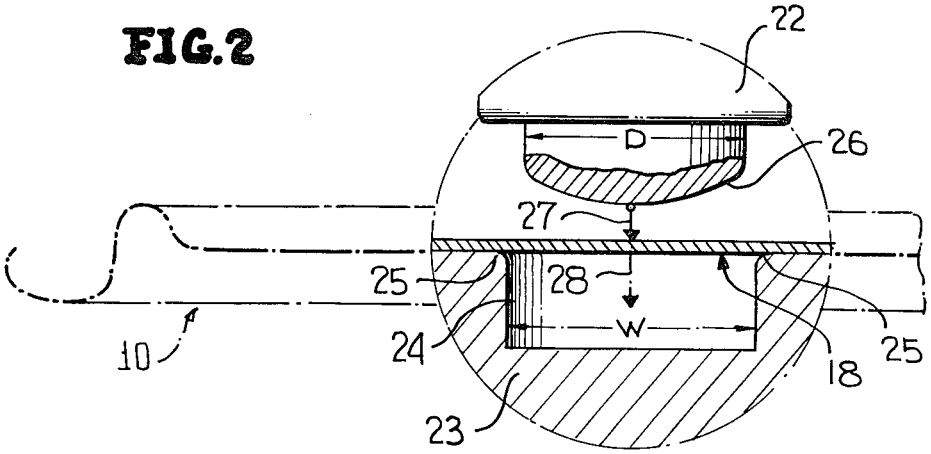
FIG. 2 is a fragmentary, schematic, cross-sectional view of a punch and die, and illustrates the manner in which a preforming punch and die are used to preform a metal tear panel.

In accordance with this invention, as depicted in FIG. 2, an end unit 10 of a container (not shown), having a tear panel, tear strip or flap area 18 to be scored, is placed between a preforming punch 22 and a die 23. The die 23 has a cavity 24, having a width W (as shown) at a given cross section, and having a curved portion 25 adjacent to the flap area 18.

The preforming punch 22 is equipped with a curved surface 26, having a width D (as shown) at a given cross section. Thus, when the curved surface 26 is moved through a distance indicated by the arrow 27, an initial contact with the flap area 18 will occur, and when the curved surface 26 is moved through a distance corresponding to the arrow 28, the flap area 18 will be preformed into a curved shape in general correspondence with the curved surface 26 of the preforming punch 22, as well as with the curved portion 25 of the die 23.

Figure 3:
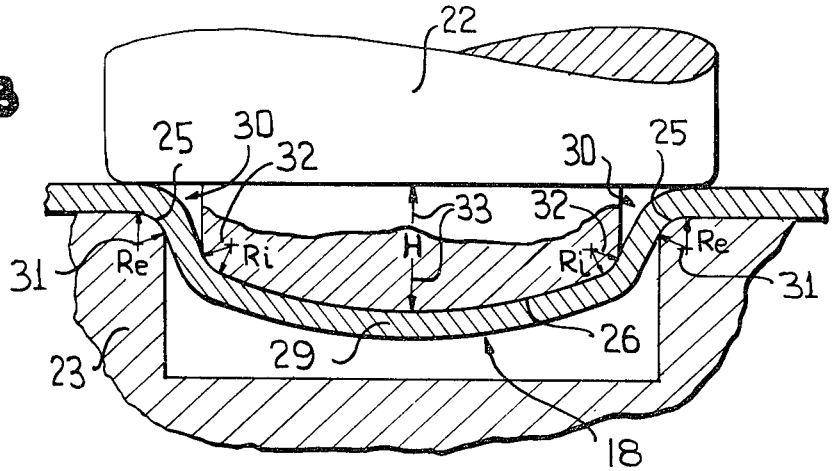
FIG. 3 is a fragmentary, schematic, cross-sectional view of a preformed metal tear panel, and illustrates the tear panel preformed between the punch and die.

FIG. 3 shows the flap area 18 after the preforming step, the flap area 18 having been deformed into an internal curved surface 29 having a concave upward orientation, and an intermediate region 30 surrounding the curved surface 29 and having a generally concave downward orientation.

It should be noted that the curved portion 25 of the die 23 has a radius of curvature $R_e$ as indicated by the arrows 31, while the curved surface 26 of the preforming punch 22 has, at its extremities, a radius of curvature $R_i$ as indicated by the arrows 32. These radii of curvature, $R_e$ and $R_i$, may or may not be equal in value.

It should also be noted that, during the preforming step, the deformed flap area 18 is displaced by a maximum distance H as indicated by the arrows 33.

Figure 4:
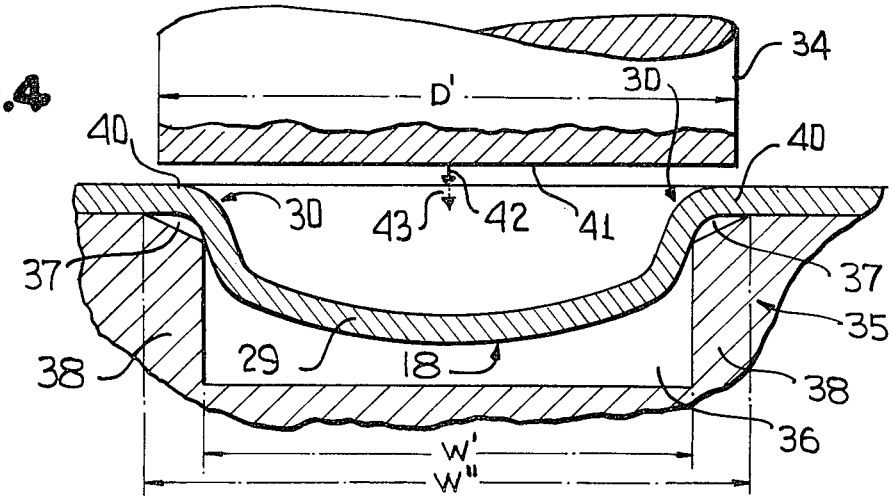
FIG. 4 is a fragmentary, schematic, cross-sectional view of a scoring punch and anvil, and illustrates the manner in which the preformed tear panel is positioned for scoring and deformation.

In FIG. 4, the flap area 18, with its internal curved surface 29 and intermediate region 30, is shown disposed between a scoring punch 34 and a scoring anvil 35. The scoring anvil 35 has an external width W″ at a given cross section, and is equipped with a cavity 36 of internal width W′ as shown. In addition, the scoring anvil 35 is so constructed at its uppermost extremities as to cause the gap 37 to be formed between the wall 38 and the outer portion 40 of intermediate region 30 of the flap area 18.

The scoring punch 34 has a scoring surface 41 which has a width D′ as shown. The punch 34 is so dimensioned and so positioned relative to the flap area 18 and the anvil 35 that, when the punch 34 is moved through the distance indicated by the arrow 42 an initial contact is made with the flap area 18 at its outer portion 40 and, when the punch 34 is moved through the additional distance indicated by the arrow 43, scoring is accomplished at the outer portion 40.

Figure 5:
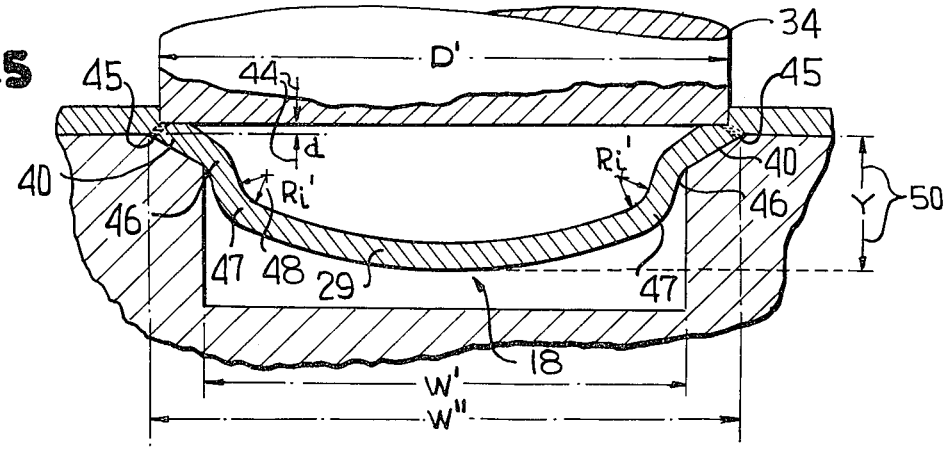
FIG. 5 is a fragmentary, schematic, cross-sectional view similar to FIG. 4, and illustrates the scored and further deformed tear panel.

FIG. 5 illustrates the effect of that scoring as follows. The punch 34 contacts the flap area 18 at outer portion 40 and moves through the entire depth of the portion 40 except for a distance d, indicated by the arrows 44. The distance d is the thickness of a generally horizontal web or scoring line 45, which, as a result of scoring, is formed about the tear panel or tear strip 18.

In addition, the force exerted by the punch 34 on the metal at the portion 40 causes a compressive stress to be built up within a stressed portion 46, thus causing a further deformation of the tear panel or tear strip 18. In the process, that portion 47, between the internal curved surface 29 and the stressed portion 46, assumes a radius of curvature $R_{i'}$ as indicated by the arrows 48, the flap area 18 being further deformed to a maximum displacement of value Y as indicated by the arrows 50. It should be noted that the radius of curvature $R_{i'}$ is lesser in value than the radius of curvature $R_i$ (shown in FIG. 3).

It has been discovered that, as a result of the above phenomena, the preformed and scored tear panel 18 is endowed with a substantially increased resistance to blowout pressure from within the metal container.

For example, if one employs a preforming punch having cross-sectional parameters D = 0.684 inches, H = 0.040 inches and $R_i$ = 0.015 inches; a die having cross-sectional parameters W = 0.704 inches and $R_e$ = 0.015 inches (see FIGS. 2 and 3); a scoring punch having cross-sectional parameter D′ = 0.750 inches; and a scoring anvil having cross-sectional parameters W′ = 0.704 inches and W″ = 0.754 inches (see FIG. 4); the practice of the above-outlined method so as to score the flap area 18 to its entire depth except for a thickness *d* (see FIG. 5) = 0.002 inches will result in a displacement of Y = 0.045 inches. Under these conditions, it has been determined that an increase in resistance to blowout pressure from within a metal container, specifically an increase of 12 pounds per square inch (psi), has resulted.

Figure 6:
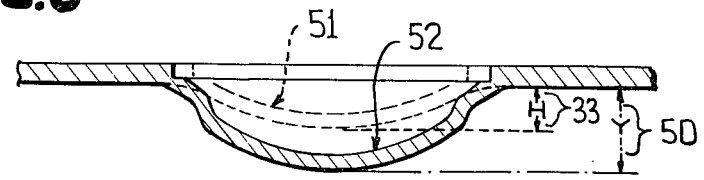
FIG. 6 is a fragmentary, diagrammatic view, and illustratively compares a preformed tear panel with a scored and further deformed tear panel.

FIG. 6 is derived from FIGS. 3 and 5, in that it shows a diagrammatical comparison between a preformed flap area 51 after the preforming step, and a further deformed and scored flap area 52 after the scoring step. It is noted that, after the preforming step, a displacement H indicated by the arrow 33 is obtained, while the scoring step results in a total displacement Y indicated by the arrow 50. Typical values for H and Y, arrived at under the conditions and with the parameters as set forth above, yielded a value for H = 0.040 inches and a value for Y = 0.045 inches. As indicated above, the additional displacement due to scoring (an amount equal to 0.005 inches in the example given) is a reaction to the internal compressive stresses built up in the metal during the scoring step. It is this reactive deformation which is responsible for the substantial increase in resistance to blowout pressure (12 psi in the example above), which increase in the resistance represents a substantial improvement over the prior art.

The detailed description of the invention set forth above will suggest various changes, substitutions and other departures from the disclosure. However, it is intended that all such changes, substitutions and departures be within the spirit and scope of the appended claims.

I claim:

1. A metal panel of a container end susceptible to blowout pressure, said metal panel comprising a flap area surrounded by an external region with an intermediate region therebetween, said flap area being curved in an inwardly convex manner, said intermediate region including a scored web of reduced thickness immediately adjacent to said external region and a stressed portion so disposed between said scored web and said flap area as to transmit stresses to said flap area, which stresses contribute to the inwardly convex curvature of said flap area, whereby said metal end wall is rendered less susceptible to blowout pressure.

2. A metal panel of a container end as recited in claim 1 wherein said flap area is spherically curved.

3. An easy-opening can end including a metal panel as recited in claim 1.

4. A container end comprising a metallic end panel, said metallic end panel including an upwardly opening generally cup-shaped area defined by a generally cup-shaped wall as viewed in cross-section, a wall radially outboard of and generally surrounding said cup-shaped wall, an intermediate wall joining said cup-shaped and outboard walls, the metal of said outboard wall being generally unstressed and undrawn, the metal of said cup-shaped wall being drawn and stressed in tension, and the metal of said intermediate wall having adjacent wall portions stressed in compression and tension.

5. The container end as defined in claim 4 wherein said compressively stressed wall portion is between said tensil stressed wall portion and said unstressed outboard wall.

* * * * *